US009512648B2

(12) United States Patent
Lin

(10) Patent No.: US 9,512,648 B2
(45) Date of Patent: Dec. 6, 2016

(54) LOCKABLE TOOL BOX

(71) Applicant: I-N-B International Inc., Taichung (TW)

(72) Inventor: Yi-Hung Lin, Taichung (TW)

(73) Assignee: I-N-B INTERNATIONAL INC., Taichung (TW)

( * ) Notice: Subject to any disclaimer, the term of this patent is extended or adjusted under 35 U.S.C. 154(b) by 55 days.

(21) Appl. No.: 14/677,052

(22) Filed: Apr. 2, 2015

(65) Prior Publication Data

US 2016/0290013 A1 Oct. 6, 2016

(51) Int. Cl.

| | |
|---|---|
| ***B65D 45/00*** | (2006.01) |
| ***E05B 65/52*** | (2006.01) |
| ***B25H 3/02*** | (2006.01) |
| ***B25H 3/00*** | (2006.01) |

(52) U.S. Cl.

CPC ..... *E05B 65/52* (2013.01); *B25H 3/003* (2013.01); *B25H 3/02* (2013.01)

(58) Field of Classification Search

CPC ..... B25H 3/003; E05B 13/105; B60R 9/055; E05G 1/005; Y10T 70/5761

USPC ..... 292/256

See application file for complete search history.

(56) References Cited

U.S. PATENT DOCUMENTS 5,680,932 A * 10/1997 Dickinson ..... B25H 3/02 206/338

9,248,566 B2 * 2/2016 Horiyama ..... B25H 3/02

* cited by examiner

*Primary Examiner* — Mark Williams

(57) ABSTRACT

A lockable tool box contains: a base, a top cover, a connection unit, and a locking unit. The connection unit is in connection with a first side of the base and a first side of the top cover. The locking unit includes a first fixing member, a second fixing member, a rotating seat, a movable cap, and a lock button. The first fixing member has an engaging slot and a retaining slot, wherein the retaining slot has a through orifice and a stop cliff; the second fixing member extends outwardly from the base, and the rotating seat is coupled with the second fixing member and is joined with the movable cap. The movable cap has an affix block and a trench, the lock button is slidably retained in the trench of and is moved between a locking position and an unlocking position, wherein the lock button has a protrusion.

6 Claims, 12 Drawing Sheets

LOCKABLE TOOL BOX

FIELD OF THE INVENTION

The present invention relates to a lockable tool box.

BACKGROUND OF THE INVENTION

A socket wrench or a screwdriver tool contains at least one socket or bit stored in a conventional tool box.

The conventional tool box has a locking switch for locking the tool box, but when it falls on the ground or collide objects, the at least one socket or bit falls out of the tool box, and the tool box is broken easily and cannot be locked by the locking switch securely.

The present invention has arisen to mitigate and/or obviate the afore-described disadvantages.

SUMMARY OF THE INVENTION

The primary objective of the present invention is to provide a lockable tool box which is locked securely.

To obtain the above objective, a lockable tool box provided by the present invention contains: a base, a top cover, a connection unit, and a locking unit.

The connection unit is in connection with a first side of the base and a first side of the top cover, such that the top cover is moved toward an opening position and a closing position relative to the base.

The locking unit includes a first fixing member, a second fixing member, a rotating seat, a movable cap, and a lock button. The first fixing member extends outwardly from a first end of the top cover, and the first fixing member has an engaging slot formed on a top surface thereof and has a retaining slot defined therein, wherein the retaining slot has a through orifice defined thereon and communicating with the retaining slot, and the retaining slot also has a stop cliff for closing the retaining slot; the second fixing member extends outwardly from the base, and the rotating seat is coupled with the second fixing member and is joined with the movable cap, the movable cap has an affix block disposed on an inner side of a free end thereof and a trench defined thereon, the lock button is slidably retained in the trench of the movable cap and is moved between a locking position and an unlocking position, wherein the lock button has a protrusion extending outwardly from an inner surface thereof.

DETAILED DESCRIPTION OF THE PREFERRED EMBODIMENTS

Figure 1:
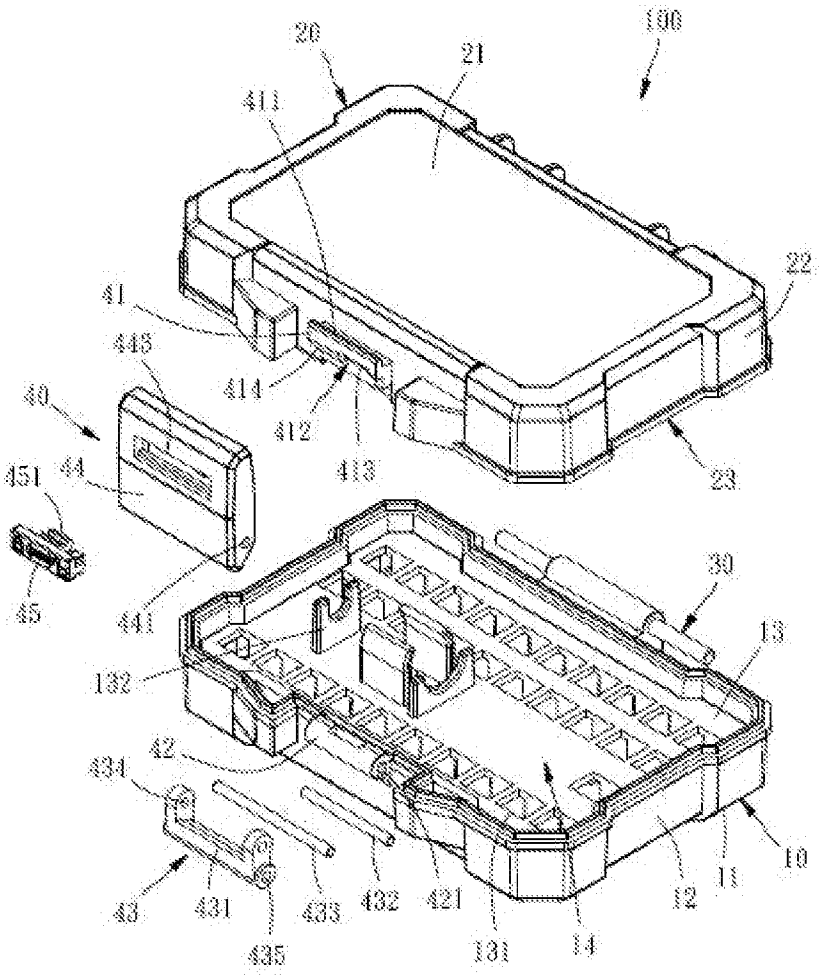
FIG. 1 is a perspective view showing the exploded components of a lockable tool box according to a preferred embodiment of the present invention.

With reference to FIGS. 1 to 12, a lockable tool box 100 according to a preferred embodiment comprises: a base 10, a top cover 20, a connection unit 30, and a locking unit 40.

Figure 2:
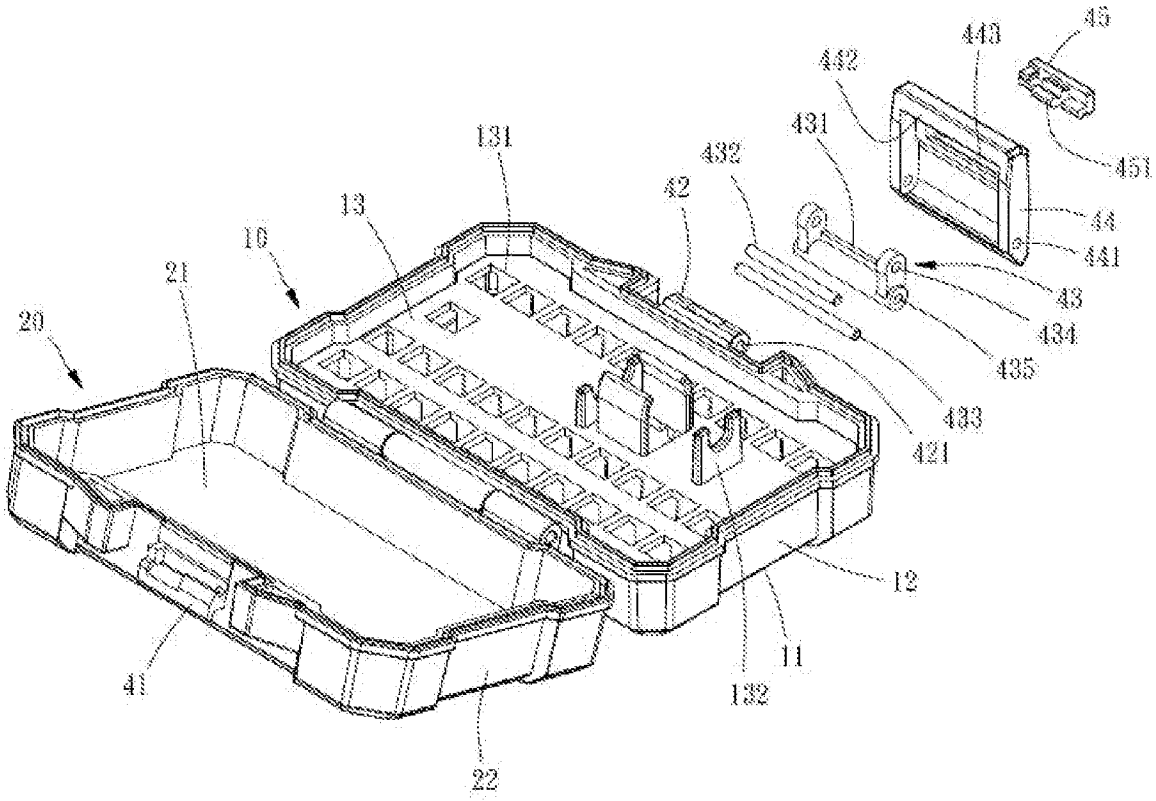
FIG. 2 is another perspective view showing the exploded components of the lockable tool box according to the preferred embodiment of the present invention.
Figure 3:
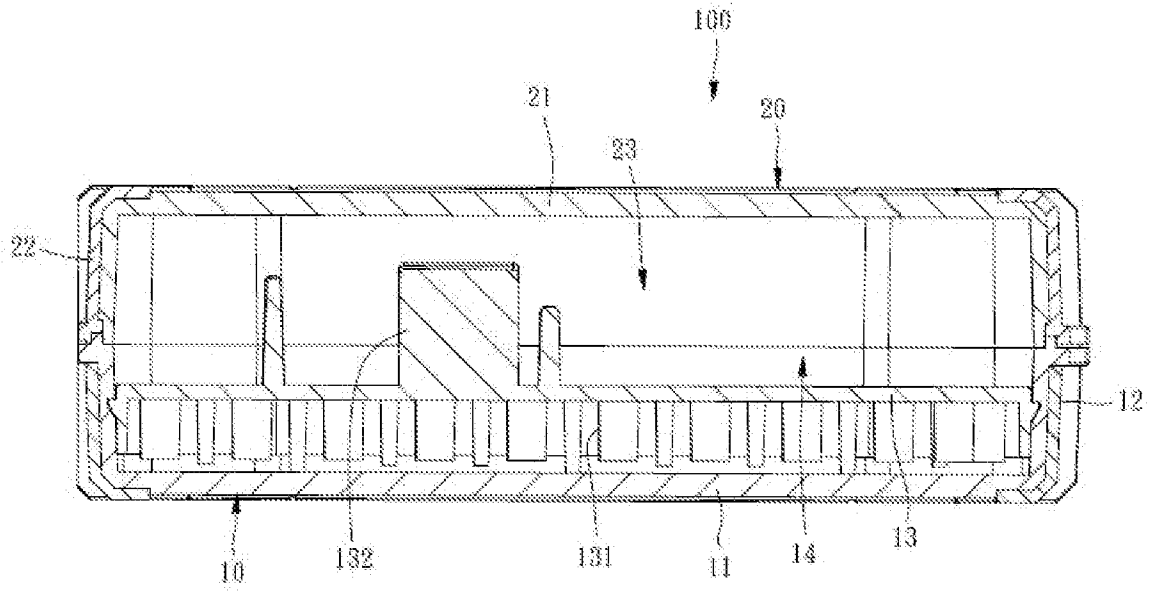
FIG. 3 is a cross sectional view showing the assembly of the lockable tool box according to the preferred embodiment of the present invention.

Referring to FIGS. 1 to 3, the base 10 includes a bottom fence 11, a peripheral fence 12, and a holding late 13, wherein the bottom fence 12 extends upwardly from the bottom fence 11, such that between the bottom fence 11 and the peripheral fence 12 is defined an accommodation chamber 14 to accommodate the holding plate 13, and the holding plate 13 has a plurality of notches 131 and plural retainers 132.

As shown in FIGS. 1 to 3, the top cover 20 includes a top fringe 21 and a side fringe 22, wherein the top fringe 21 extends downwardly from the side fringe 22, such that between the top fringe 21 and the side fringe 22 is defined a cavity 23.

As illustrated in FIGS. 1 to 3, the connection unit 30 is in connection with a first side of the bottom fence 12 of the base 10 and a first side of the side fringe 22 of the top cover 20, such that the top cover 20 is moved toward an opening position and a closing position relative to the base 10.

With reference to FIGS. 1 to 3, the locking unit 40 is mounted between a second side of the bottom fence 12 of the base 10 and a second side of the side fringe 22 of the top cover 20, such that when the top cover 20 and the base 10 are located at the closing position, the locking unit 40 locks the top cover 20 and the base 10 to prevent the top cover 20 and the base 10 being moved toward the opening position.

The locking unit 40 includes a first fixing member 41, a second fixing member 42, a rotating seat 43, a movable cap 44, and a lock button 45. The first fixing member 41 extends outwardly from a first end of the top cover 20, and the first fixing member 41 has an engaging slot 411 formed on a top surface thereof and has a retaining slot 412 defined therein, wherein the retaining slot 412 has a through orifice 413 defined thereon and communicating with the retaining slot 412, and the retaining slot 412 also has a stop cliff 414 for closing the retaining slot 412. The second fixing member 42 extends outwardly from the peripheral fence 12 of the base 10 and has an aperture 421 formed thereon. The rotating seat 43 has a body 431, a first shaft 432, and a second shaft 433, wherein the body 431 has a first hole 434 defined on a first end thereof and has a second hole 435 formed on a second end thereof, the first shaft 432 is inserted through the aperture 421 of the second fixing member 42 and the first hole 434 of the body 431, such that the rotating seat 43 is coupled with the second fixing member 42. The movable cap 44 has an opening 441, and the second shaft 433 of the rotating seat 43 is inserted through the opening 441 of the movable cap 44 and the second hole 435 of the body 431, such that the rotating seat 43 is joined with the movable cap 44. The movable cap 44 has an affix block 442 disposed on an inner side of a free end thereof and a trench 443 defined thereon. The lock button 45 is slidably retained in the trench 443 of the movable cap 44 and is moved between a locking position and an unlocking position, wherein the lock button 45 has a protrusion 451 extending outwardly from an inner surface thereof.

Figure 4:
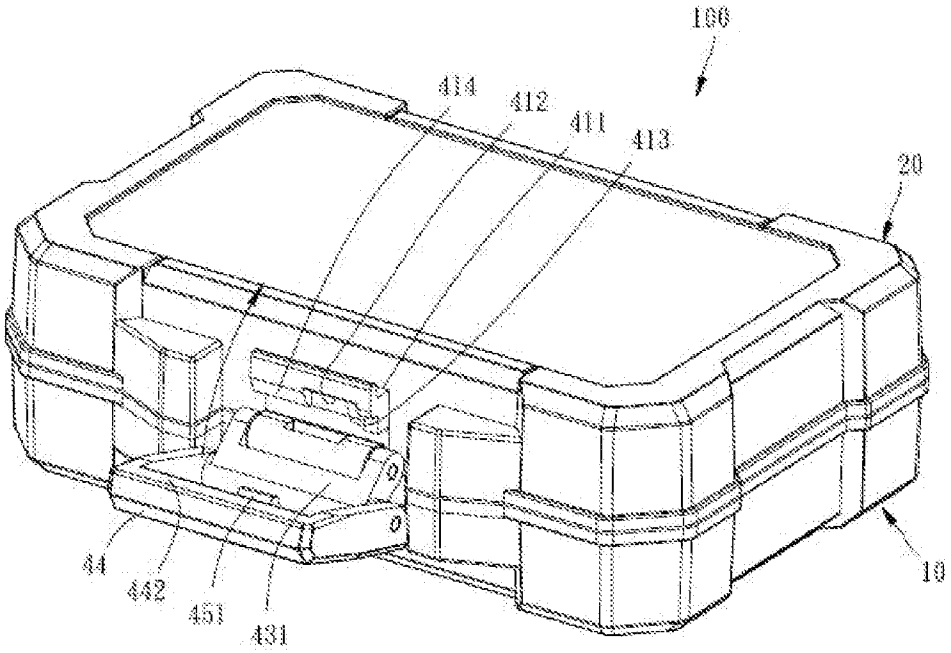
FIG. 4 is a perspective view showing the operation of the lockable tool box according to the preferred embodiment of the present invention.
Figure 5:
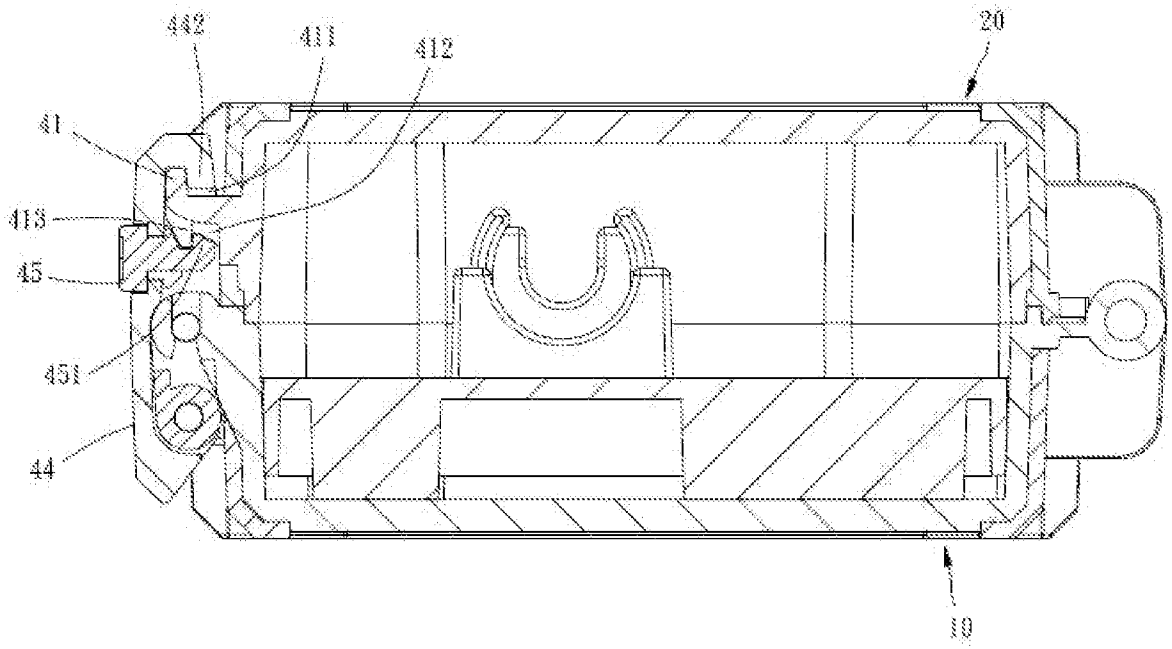
FIG. 5 is a cross sectional view showing the operation of the lockable tool box according to the preferred embodiment of the present invention.
Figure 6:
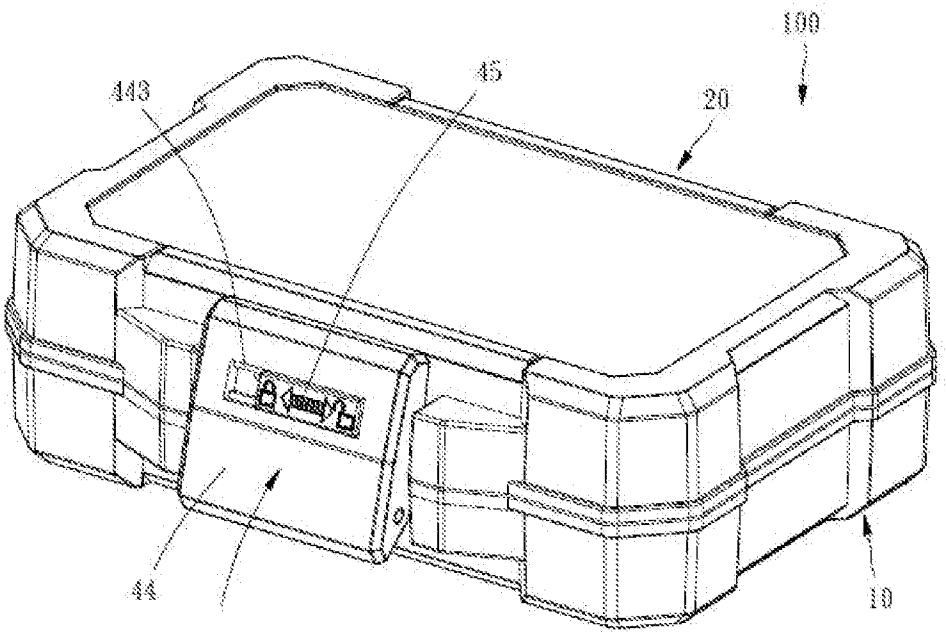
FIG. 6 is another perspective view showing the operation of the lockable tool box according to the preferred embodiment of the present invention.
Figure 7:
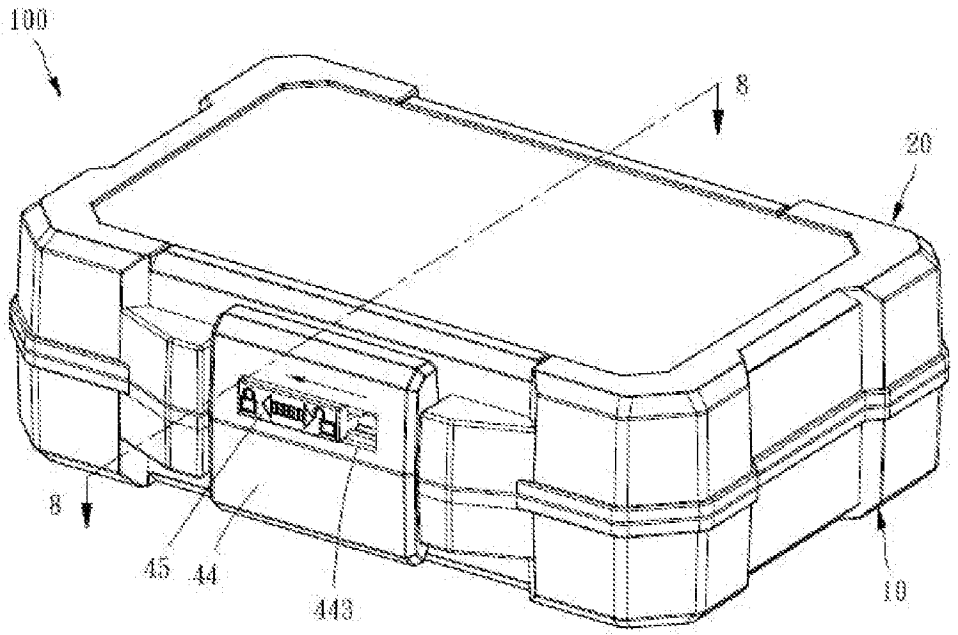
FIG. 7 is also another perspective view showing the operation of the lockable tool box according to the preferred embodiment of the present invention.
Figure 8:
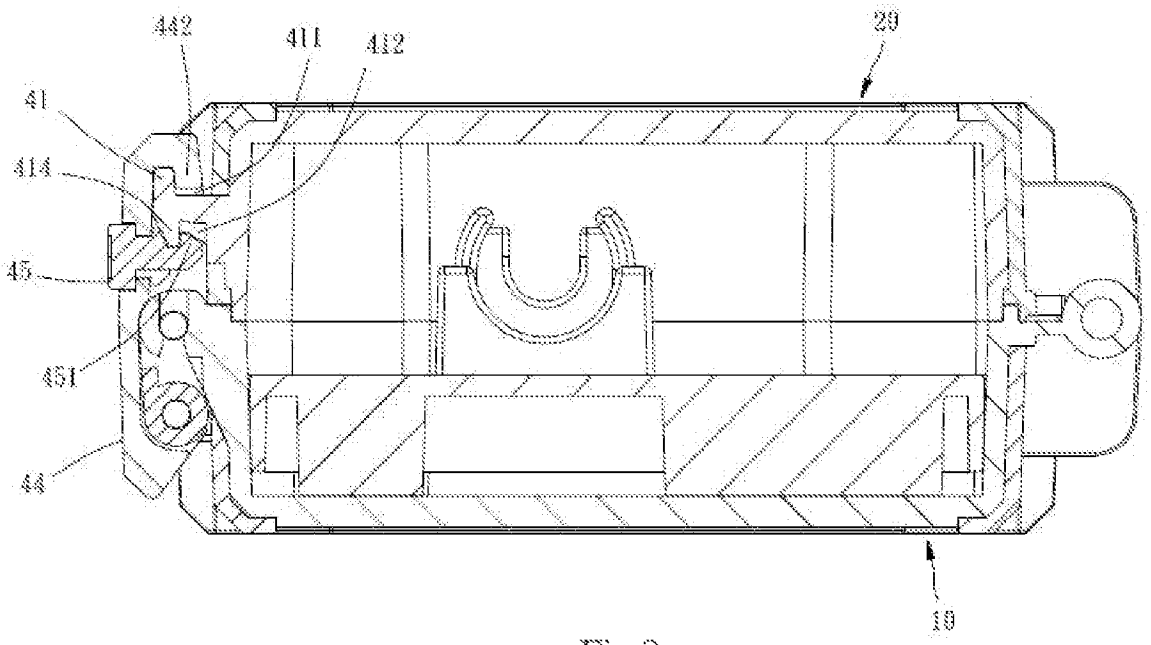
FIG. 8 is another cross sectional view showing the operation of the lockable tool box according to the preferred embodiment of the present invention.

In operation, the lock button 45 is moved toward the unlocking position, and the movable cap 44 of the locking unit 40 is rotated upwardly (as shown in FIG. 4), such that the affix block 442 of the movable cap 44 retains in the engaging slot 411 of the first fixing member 41 (as illustrated in FIG. 5), and the movable cap 44 is pressed downwardly (as shown in FIG. 6), hence the protrusion 451 of the lock button 45 moves into the retaining slot 412 from the through orifice 413 (as shown in FIG. 5), thereafter the lock button 45 is moved toward the locking position (as illustrated in FIG. 7) so that the protrusion 451 slides in the retaining slot 412 and toward the stop cliff 414 (as shown in FIG. 8).

Thereby, the movable cap 44 is locked by retaining the affix block 442 with the engaging slot 411 of the first fixing member 41, and the protrusion 451 of the lock button 45 is stopped by the stop cliff 414 of the first fixing member 41, such that the locking unit 40 locks the base 10 and the top cover 20 securely.

Figure 9:
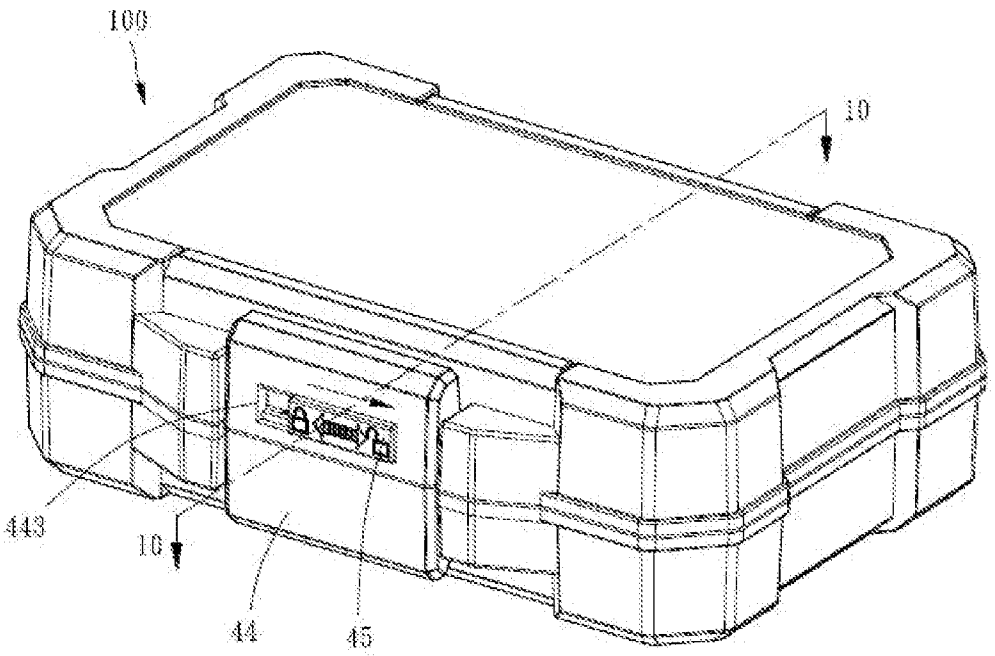
FIG. 9 is still another perspective view showing the operation of the lockable tool box according to the preferred embodiment of the present invention.
Figure 10:
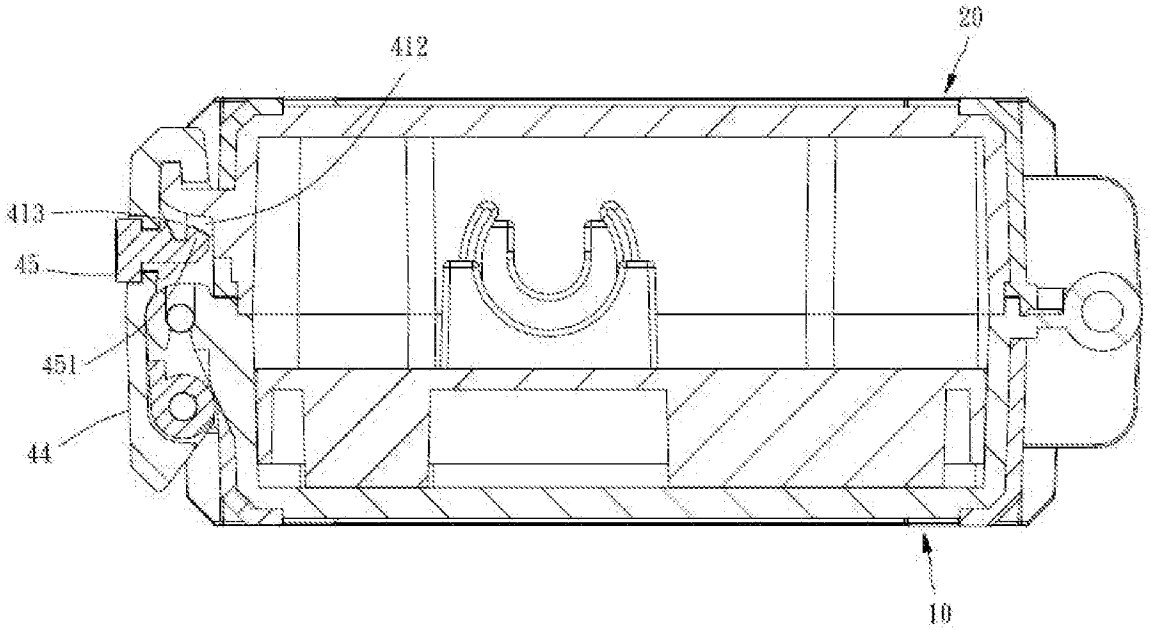
FIG. 10 is also another cross sectional view showing the operation of the lockable tool box according to the preferred embodiment of the present invention.
Figure 11:
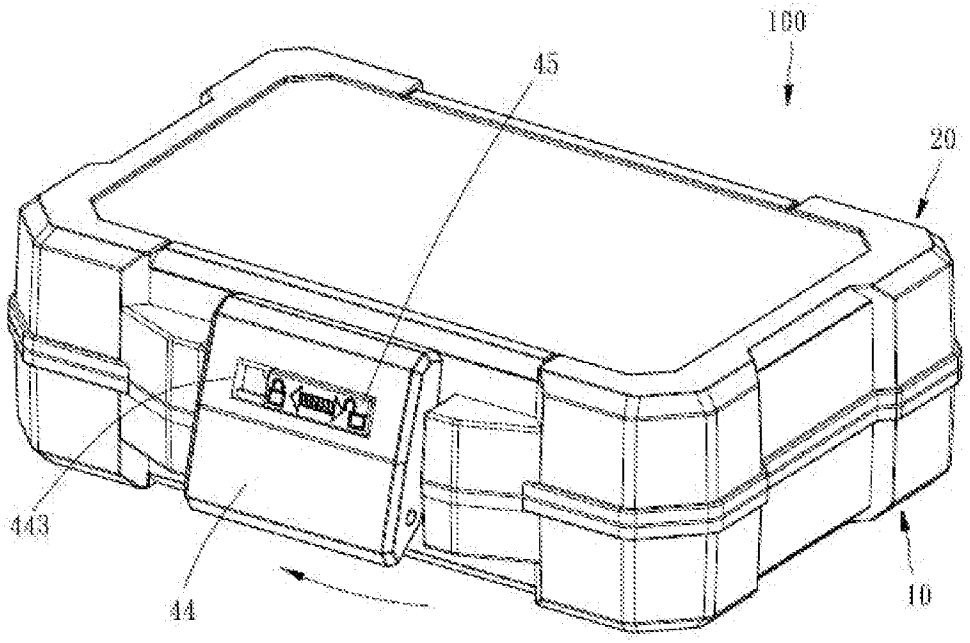
FIG. 11 is another perspective view showing the operation of the lockable tool box according to the preferred embodiment of the present invention.
Figure 12:
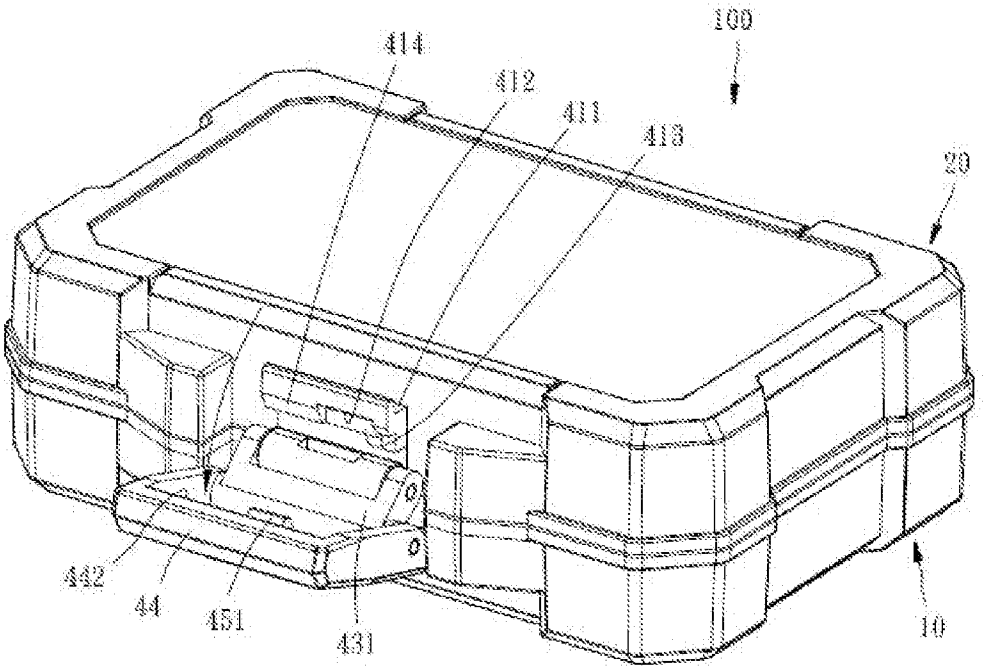
FIG. 12 is also another perspective view showing the operation of the lockable tool box according to the preferred embodiment of the present invention.

As desiring to open the lockable tool box, the lock button 45 is moved to the unlocking position (as illustrated in FIG. 9), such that the protrusion 451 of the lock button 45 moves to the through orifice 413 from the stop cliff 414 (as shown in FIG. 10), and then the movable cap 44 is pulled away from the rotating seat 43 (as shown in FIG. 11), thereafter the affix block 442 of the movable cap 44 is removed from the engaging slot 411 of, thus opening the movable cap 44 (as illustrated in FIG. 12).

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A lockable tool box comprising:

a base;

a top cover;

a connection unit being in connection with a first side of the base and a first side of the top cover, such that the top cover is moved toward an opening position and a closing position relative to the base;

a locking unit including a first fixing member, a second fixing member, a rotating seat, a movable cap, and a lock button;

wherein the first fixing member extends outwardly from a first end of the top cover, and the first fixing member has an engaging slot formed on a top surface thereof and has a retaining slot defined therein, wherein the retaining slot has a through orifice defined thereon and communicating with the retaining slot, and the retaining slot also has a stop cliff for closing the retaining slot;

wherein the second fixing member extends outwardly from the base, and the rotating seat is coupled with the second fixing member and is joined with the movable cap;

wherein the movable cap has an affix block disposed on an inner side of a free end thereof and has a trench defined thereon;

wherein the lock button is slidably retained in the trench of the movable cap and is moved between a locking position and an unlocking position, and wherein the lock button has a protrusion extending outwardly from an inner surface thereof;

wherein when the lock button is moved toward the unlocking position and the movable cap of the locking unit is rotated upwardly, the affix block of the movable cap retains in the engaging slot of the first fixing member, and the movable cap is pressed downwardly, such that the protrusion of the lock button moves into the retaining slot from the through orifice, and the lock button is moved toward the locking position so that the protrusion slides in the retaining slot and toward the stop cliff; and wherein when the lock button is moved to the unlocking position, the protrusion of the lock button moves to the through orifice from the stop cliff, and the movable cap is pulled away from the rotating seat so that the affix block of the movable cap is removed from the engaging slot, thus opening the movable cap.

2. The lockable tool box as claimed in claim 1, wherein the base includes a bottom fence and a peripheral fence, wherein the bottom fence extends upwardly from the bottom fence, such that between the bottom fence and the peripheral fence is defined an accommodation chamber, the connection unit is connected with the bottom fence, and the second fixing member extends outwardly from the peripheral fence of the base.

3. The lockable tool box as claimed in claim 2, wherein the holding plate has a plurality of notches and plural retainers.

4. The lockable tool box as claimed in claim 3, wherein the base further includes a holding plate accommodated in the accommodation chamber, and the holding plate has the plurality of notches and the plural retainers which are formed on the holding plate.

5. The lockable tool box as claimed in claim 1, wherein the top cover includes a top fringe and a side fringe, wherein the top fringe extends downwardly from the side fringe, such that between the top fringe and the side fringe is defined a cavity, and the connection unit is joined with the top fringe, the first fixing member extends outwardly from the side fridge.

6. The lockable tool box as claimed in claim 1, wherein the second fixing member has an aperture formed thereon; the rotating seat has a body, a first shaft, and a second shaft, wherein the body has a first hole defined on a first end thereof and has a second hole formed on a second end thereof, the first shaft is inserted through the aperture of the second fixing member and the first hole of the body; the movable cap has an opening, and the second shaft of the rotating seat is inserted through the opening of the movable cap and the second hole of the body.

* * * * *